US009682271B2

(12) United States Patent
Canali

(10) Patent No.: US 9,682,271 B2
(45) Date of Patent: Jun. 20, 2017

(54) GYMNASTIC EXERCISE MACHINE FOR AUXOTONIC MUSCLE TRAINING

(71) Applicant: Vincenzo Canali, Tizzano Val Parma (IT)

(72) Inventor: Vincenzo Canali, Tizzano Val Parma (IT)

( * ) Notice: Subject to any disclaimer, the term of this patent is extended or adjusted under 35 U.S.C. 154(b) by 0 days.

(21) Appl. No.: 14/778,466

(22) PCT Filed: Mar. 14, 2014

(86) PCT No.: PCT/EP2014/055167

§ 371 (c)(1),
(2) Date: Sep. 18, 2015

(87) PCT Pub. No.: WO2014/146987

PCT Pub. Date: Sep. 25, 2014

(65) Prior Publication Data

US 2016/0303418 A1 Oct. 20, 2016

(30) Foreign Application Priority Data

Mar. 19, 2013 (IT) ..... MI2013A0412

(51) Int. Cl.
*A63B 21/068* (2006.01)
*A63B 23/035* (2006.01)
(Continued)

(52) U.S. Cl.
CPC ..... *A63B 21/068* (2013.01); *A63B 21/00072* (2013.01); *A63B 21/4033* (2015.10);
(Continued)

(58) Field of Classification Search
CPC ..... A63B 21/00058; A63B 21/00069; A63B 21/00072; A63B 21/0407; A63B 21/0421;
(Continued)

(56) References Cited

U.S. PATENT DOCUMENTS 5,370,594 A 12/1994 Grinblat
5,549,530 A * 8/1996 Fulks ..... A63B 21/00072 482/100

(Continued)

FOREIGN PATENT DOCUMENTS

CN 101607124 A 12/2009
DE 10145508 C1 4/2003
WO WO 2009/004458 A2 1/2009

OTHER PUBLICATIONS

International Search Report and Written Opinion dated Jun. 11, 2014 issued in PCT/EP2014/055167.

*Primary Examiner* — Loan H Thanh
*Assistant Examiner* — Gregory Winter
(74) *Attorney, Agent, or Firm* — Scullt, Scott, Murphy & Presser, P.C.

(57) ABSTRACT

A gymnastic exercise machine, particularly for anaerobic auxotonic muscle training, that includes supporting footing that is provided with a movable frame that is associated with a folding seat, the movable frame being provided with a lever that can be actuated by a user located on the folding seat in order to move the movable frame with respect to the supporting footing with consequent folding of the folding seat in contrast with the action of the weight of the user, coarse adjustment elements being further provided which are associated with the movable frame in order to reduce or increase the force required to actuate the lever. The machine further includes fine adjustment mechanisms which are associated with the movable frame in order to reduce or increase the force required to actuate the lever.

8 Claims, 3 Drawing Sheets

(51) Int. Cl.

| | |
|---|---|
| ***A63B 23/04*** | (2006.01) |
| ***A63B 21/00*** | (2006.01) |
| ***A63B 22/00*** | (2006.01) |
| *A63B 71/02* | (2006.01) |

(52) U.S. Cl.
CPC ..... *A63B 21/4047* (2015.10); *A63B 22/0087* (2013.01); *A63B 23/0355* (2013.01); *A63B 23/03508* (2013.01); *A63B 23/0494* (2013.01); *A63B 2071/025* (2013.01); *A63B 2208/0233* (2013.01)

(58) Field of Classification Search
CPC ..... A63B 21/0435; A63B 21/055; A63B 21/0552; A63B 21/068; A63B 21/4033; A63B 21/4047; A63B 22/0087; A63B 22/0089; A63B 23/0494; A63B 23/0233; A63B 23/12; A63B 23/0355; A63B 23/03575
See application file for complete search history.

(56) References Cited

U.S. PATENT DOCUMENTS

| | | | | |
|---|---|---|---|---|
| 5,944,641 | A | 8/1999 | Habing | |
| 5,997,446 | A | 12/1999 | Stearns | |
| 6,162,153 | A * | 12/2000 | Perez, Jr. ..... | A63B 21/068 482/118 |
| 2004/0229737 | A1 | 11/2004 | Stearns | |
| 2006/0252613 | A1 | 11/2006 | Barnes et al. | |
| 2010/0144500 | A1* | 6/2010 | Canali ..... | A63B 21/04 482/137 |
| 2014/0296042 | A1* | 10/2014 | Snyder ..... | A63B 23/0205 482/112 |

* cited by examiner

GYMNASTIC EXERCISE MACHINE FOR AUXOTONIC MUSCLE TRAINING

The present invention relates to a gymnastic exercise machine, particularly for auxotonic muscle training and for functional recovery.

Nowadays, machines are known for gymnastic exercises which, instead of using weights to achieve the exercise, as occurs with more traditional machines, use the weight of the user who is resting on the sitting portion of the machine.

In more detail, such machines have a sitting portion that can oscillate between two positions, in a controlled manner, by way of particular kinetic mechanisms that are connected to the levers for actuating the machine.

In essence, with the user actuating with his/her limbs, be they legs or arms according to the type of machine, such levers cause the oscillation of the sitting portion.

Obviously, such operation requires effort by the user with consequent exercising of the muscles involved in the actuation of such levers.

According to the dimensioning of the kinematic mechanism, for the same body mass of the user, it is possible to vary the force necessary to actuate the kinetic mechanisms.

Such conventional machines for gymnastic exercises are not devoid of drawbacks, among which is the fact that it is not possible to vary the force necessary for the actuation of the machine below or above determined limits.

In fact, in conventional machines, such possibility can be obtained by varying the lever arms of the levers used, with a range that is not adapted to the entire population, thus defeating the purpose of the gymnastic exercise, since sometimes it results in over-exercising or insufficient exercise in some persons.

Another drawback suffered by the above mentioned machines consists in that, if an immediate change of the level of intensity of the exercise is not required, it is not possible to perform an accurate adjustment of the force necessary.

The aim of the present invention consists in providing a gymnastic exercise machine, particularly for auxotonic muscle training, which offers a high level of sensitivity in the adjustment of the force necessary to actuate the lever mechanisms that are present in the machine.

Within this aim an object of the present invention consists in providing a gymnastic exercise machine that makes it possible to adjust the force necessary to actuate the above mentioned lever mechanisms rapidly and effectively and with an excursion that is very long and with fine adjustment.

This aim and these and other objects which will become better apparent hereinafter are achieved by a gymnastic exercise machine, particularly for anaerobic auxotonic muscle training, comprising a supporting footing provided with a movable frame that is associated with a folding seat, said movable frame being provided with lever means that can be actuated by a user located on said folding seat in order to move said movable frame with respect to said supporting footing with consequent folding of said folding seat in contrast with the action of the weight of said user, coarse adjustment means being provided and being associated with said movable frame in order to reduce or increase the force required to actuate said lever means, characterized in that it comprises fine adjustment means associated with said movable frame in order to reduce or increase the force required to actuate said lever means.

Further characteristics and advantages of the invention will become better apparent from the description of two preferred, but not exclusive, embodiments of a gymnastic exercise machine, particularly for anaerobic auxotonic muscle training, according to the invention, which are illustrated by way of non-limiting example in the accompanying drawings, wherein.

Figure 1:
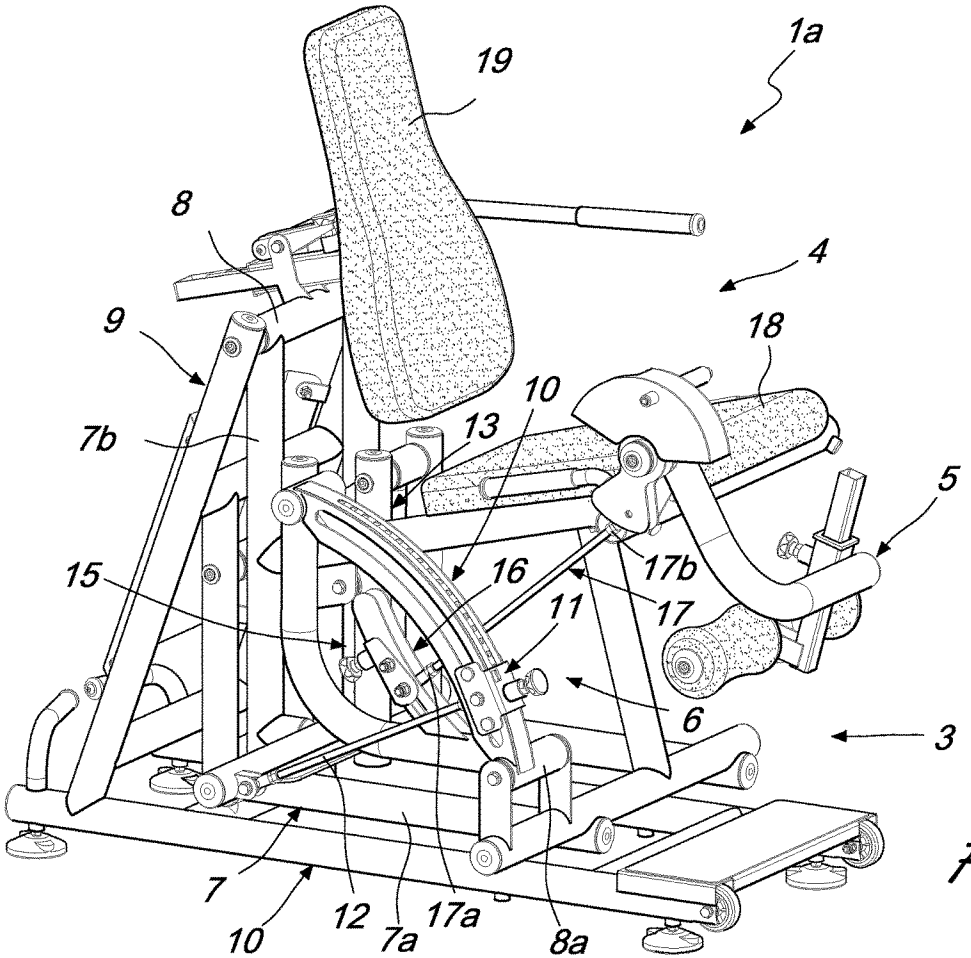
FIG. 1 is a perspective view of a first embodiment of the gymnastic exercise machine, particularly for auxotonic muscle training, according to the invention.

With reference to the figures, the gymnastic exercise machine, particularly for auxotonic muscle training, which is respectively designated in the two proposed embodiments with the reference numerals 1*a* and 1*b*, comprises a supporting footing 2 provided with a movable frame 3 that is associated with a folding seat 4.

Conveniently, the movable frame 3 is provided with lever means 5 that can be actuated by a user located on the folding seat 4 in order to move the movable frame 3 with respect to the supporting footing 2 with consequent folding of the folding seat 4 in contrast with the action of the weight of the user.

Advantageously, coarse adjustment means 6 are provided and are associated with the movable frame 3 in order to reduce or increase the force required to actuate the lever means 5.

In more detail, when seen in a side elevation view, the above mentioned movable frame 4 comprises a substantially L-shaped structure 7 that is pivoted at one of its ends 8 to a fixed structure 9 that is integral with the supporting footing 2 so as to have, in the inactive position, one side 7*a* of the L-shape that is parallel and adjacent to the supporting footing 2 and the other side 7*b* of the L-shape that is substantially perpendicular to the supporting footing 2.

As shown in the figures, the coarse adjustment means 6 comprise at least one adjustment arc 10, one only for the first embodiment and two parallel ones for the second embodiment, pivoted at one of its ends 8*a* proximate to the other end of the substantially L-shaped structure 7 so as to be directed toward the substantially L-shaped structure 7 itself.

The coarse adjustment means 6 further comprise a movable slider 11, with which each adjustment arc 10 is provided, and which can be positioned selectively along the longitudinal extension of the respective adjustment arc 10, and is also pivoted to a first tension element 12 that is pivoted to the end of a rocker-like rod 13 that is pivoted at a central portion of itself to the side 7*a* of the substantially L-shaped structure 7 and has the other end pivoted to a link rod 14, which in turn is pivoted to the fixed structure 9 at a height that is intermediate between the pivoting of the substantially L-shaped structure 7 with the fixed structure 9 and the corner of the substantially L-shaped structure 7.

As will be better described hereinafter, in this way it is possible to perform the coarse adjustments of the force required to actuate the lever means 5, for example with a granularity of ten percentage points.

According to the invention, fine adjustment means 15 are provided which are associated with the movable frame 3 in order to reduce or increase the force required to actuate the lever means 5.

Such fine adjustment means 15 comprise a supporting element 16 that rotates integrally with the adjustment arcs 10 and a second tension element 17 that is pivoted, at a first terminal 17*a* thereof, to the supporting element 16 at a plurality of selectively selectable pivoting points and, at a second terminal 17*b* thereof, to the lever means 5 on the opposite side with respect to the point of application of the force required for the actuation of the lever means 5 with respect to the fulcrum of those lever means 5.

Figure 2:
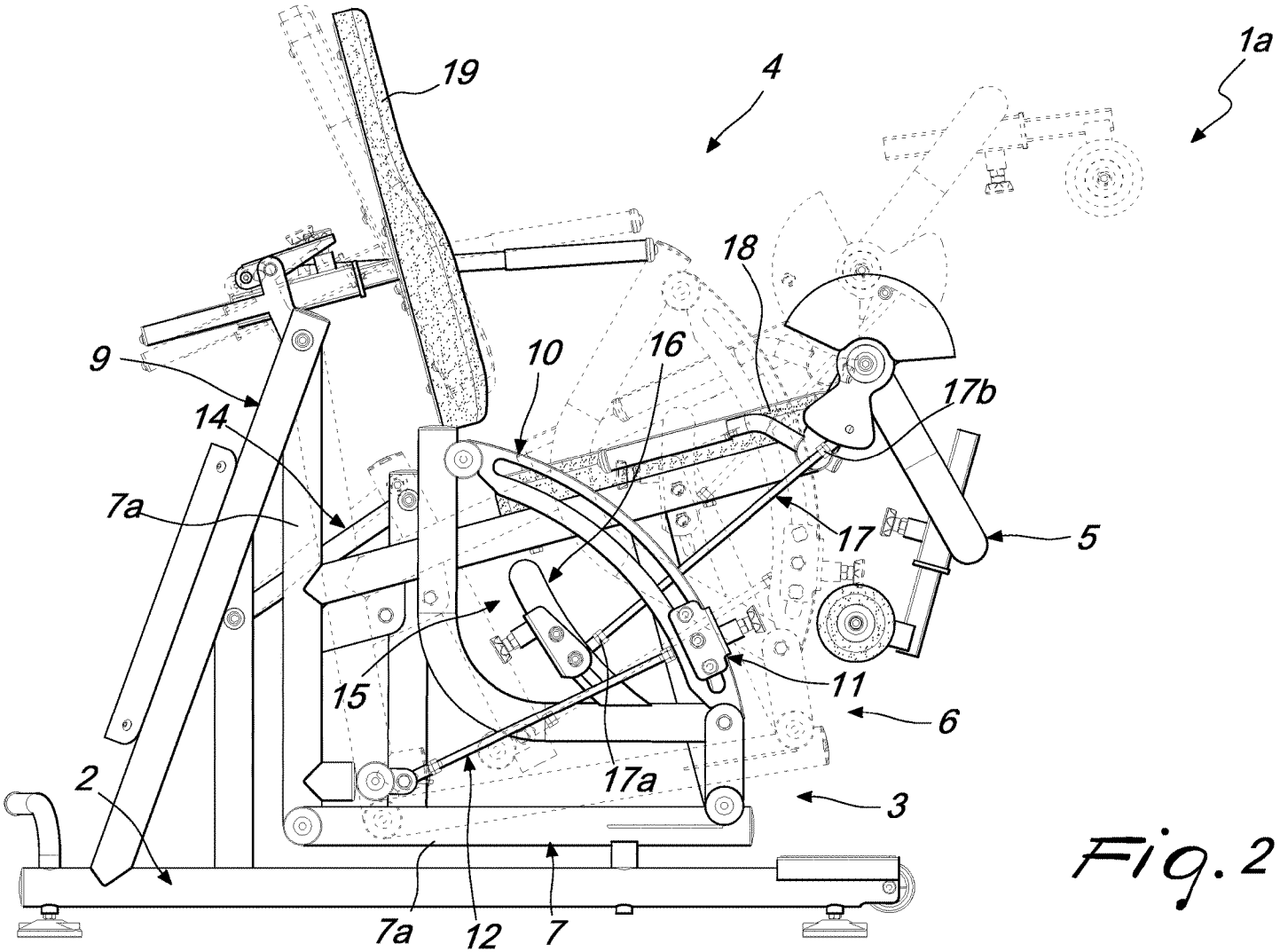
FIG. 2 is a side elevation view of the gymnastic exercise machine shown in FIG. 1, in which its operation is shown.

With particular reference to FIGS. 1 and 2, in the first embodiment proposed, the gymnastic exercise machine 1*a* is a machine adapted for exercising the quadriceps muscles of the lower limbs.

Conveniently, in this gymnastic exercise machine 1*a*, the folding seat 4 comprises a first sitting portion 18 and a backrest 19, which are arranged substantially parallel to the sides of the substantially L-shaped structure 7 so that the user, when seated on the folding seat 4, has his/her back to the fixed structure 9.

The lever means 5 are arranged at the end part of the first sitting portion 18 and are adapted to interact with the legs of the user.

Figure 3:
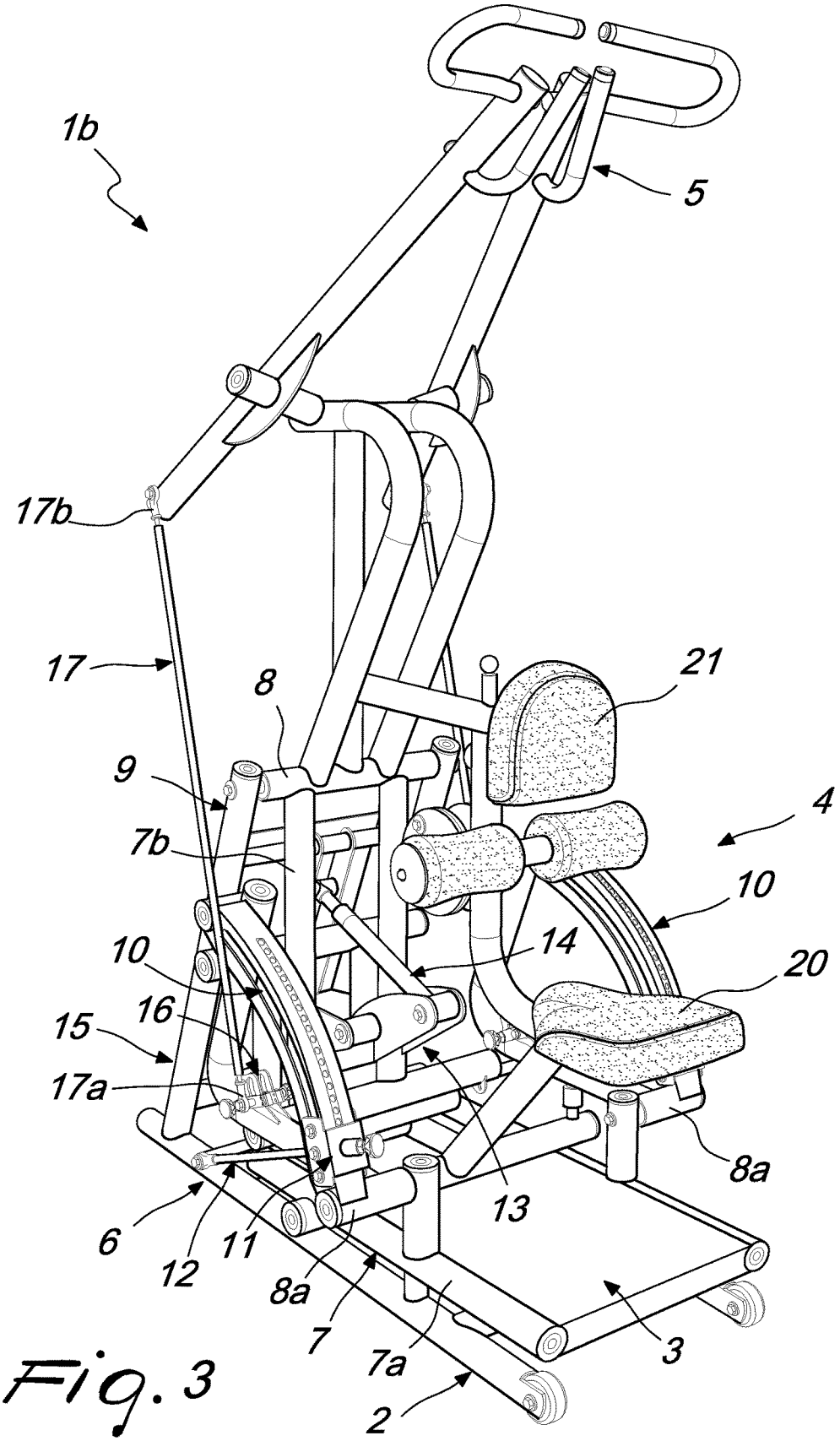
FIG. 3 is a perspective view of a second embodiment of the gymnastic exercise machine, particularly for auxotonic muscle training, according to the invention.

With particular reference to FIG. 3, in the second embodiment proposed, the gymnastic exercise machine 1*b* is a machine adapted for exercising the dorsal muscles.

Conveniently, in this gymnastic exercise machine 1*b*, the folding seat 4 comprises a second sitting portion 20 and a cushion for resting the abdomen 21, which are arranged substantially parallel to the sides of the substantially L-shaped structure 7 so that the user, when seated on the folding seat 4, is facing toward the fixed structure 9.

The lever means 5 are arranged above the folding seat 4 so that they can be gripped by the user.

Operation of the machines for gymnastic exercises 1*a* and 1*b* is described hereinafter.

With particular reference to FIG. 2, in which only the first proposed embodiment is shown, the operating principle of which is the same as that of the second embodiment, the user by interacting with the lever means 5, by way of the second tension element 17, makes the adjustment arc 10 rotate with respect to the substantially L-shaped structure 7.

The rotation of the adjustment arc 10 makes the rocker-like rod 13 rotate and push forward the substantially L-shaped structure 7, thus making it rotate with respect to the fixed structure 9.

In this way the folding of the folding seat 4 is obtained.

By acting on the movable slider 11 it is possible to discretely vary the effort required to actuate the machine, which as mentioned previously is proportional to the weight of the user, in order to increase or decrease the level of intensity of the exercise.

Such system of adjustment acts on a part of the machine that is such as to permit only the coarse adjustment thereof, for example with a granularity of ten percentage points.

By acting on the coupling of the second tension element 17 to the supporting element 16, it is possible to further break down each step of the coarse adjustment, thus also obtaining a fine adjustment of the level of intensity of the exercise.

In practice it has been found that the gymnastic exercise machine, particularly for auxotonic muscle training, according to the invention, fully achieves the set aim and objects, in that it enables both a coarse adjustment and a fine adjustment of the level of intensity of the exercise, thus offering a high level of sensitivity in the adjustment of the force necessary to actuate the lever mechanisms that are present in the machine.

Another advantage of the gymnastic exercise machine, according to the present invention, consists in that it enables the above mentioned adjustments simply, rapidly and effectively.

The gymnastic exercise machine, particularly for the anaerobic auxotonic exercise of muscles, thus conceived, is susceptible of numerous modifications and variations, all of which are within the scope of the appended claims.

For example, it is possible to apply the principle of such machine for exercising other muscular groups than the ones described.

Moreover, all the details may be substituted by other, technically equivalent elements.

In practice the materials employed, and the contingent dimensions and shapes, may be any according to requirements and to the state of the art.

The disclosures in Italian Patent Application No. MI2013A000412 from which this application claims priority are incorporated herein by reference.

The invention claimed is:

1. A gymnastic exercise machine, particularly for anaerobic auxotonic muscle training, comprising a supporting footing that is provided with a movable frame that is associated with a folding seat, said movable frame being provided with lever means that can be actuated by a user located on said folding seat in order to move said movable frame with respect to said supporting footing with consequent folding of said folding seat in contrast with an action of a weight of said user, coarse adjustment means being provided and being associated with said movable frame in order to reduce or increase the force required to actuate said lever means, further comprising fine adjustment means associated with said movable frame in order to reduce or increase the force required to actuate said lever means, wherein in a side elevation view said movable frame comprises:

a substantially L-shaped structure that is pivoted at one end to a fixed structure that is integral with said supporting footing so as to have, in an inactive position, one side of said L-shape structure that is parallel and adjacent to said supporting footing and another side of said L-shape structure that is substantially perpendicular to said supporting footing, and at least one adjustment arc, which is pivoted at one end proximate to another end of said substantially L-shaped structure so as to be directed toward said substantially L-shaped structure, said at least one adjustment arc being provided with a movable slider that can be positioned selectively along a longitudinal extension of said at least one adjustment arc and being pivoted to a first tension element that is pivoted to an end of a rocker-like rod that is pivoted at a central portion to said one side of said substantially L-shaped structure and the rocker-like rod has another end pivoted to a link rod, which in turn is pivoted to said fixed structure at a height that is intermediate between the pivoting of said substantially L-shaped structure to said fixed structure and a corner of said substantially L-shaped structure, said at least one adjustment arc and said movable slider defining said coarse adjustment means.

2. The gymnastic exercise machine according to claim 1, wherein said fine adjustment means comprise a supporting element that rotates integrally with said at least one adjustment arc and a second tension element that is pivoted, at a first terminal thereof, to said supporting element at a plurality of selectively selectable pivoting points and, at a second terminal thereof, to said lever means on an opposite side with respect to a point of application of the force required for the actuation of said lever means with respect to a fulcrum of said lever means.

3. The gymnastic exercise machine according to claim 1, wherein the gymnastic exercise machine is adapted for exercising the quadriceps muscles of the lower limbs.

4. The gymnastic exercise machine according to claim 1, wherein said folding seat comprises a first sitting portion and a backrest, which are arranged substantially parallel to said sides of said substantially L-shaped structure so that the user, when seated on said folding seat, has the user's back to said fixed structure.

5. The gymnastic exercise machine according to claim 4, wherein said lever means are arranged at the end part of said first sitting portion and are adapted to interact with the legs of the user.

6. The gymnastic exercise machine according to claim 1, wherein the gymnastic exercise machine is adapted for exercising the dorsal muscles.

7. The gymnastic exercise machine according to claim 1, wherein said folding seat comprises a sitting portion and a cushion for resting the abdomen, which are arranged substantially parallel to said sides of said substantially L-shaped structure so that the user, when seated on said folding seat, is facing toward said fixed structure.

8. The gymnastic exercise machine according to claim 1, wherein said lever means are arranged above said folding seat so that the lever means can be gripped by the user.

* * * * *